US007588126B2

(12) United States Patent
Siikonen et al.

(10) Patent No.: US 7,588,126 B2
(45) Date of Patent: Sep. 15, 2009

(54) BUILDING EVACUATION ELEVATOR SYSTEM

(75) Inventors: Marja-Liisa Siikonen, Helsinki (FI); Kim Bärlund, Lyngby Taarbaek (DK)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/078,064

(22) Filed: Mar. 26, 2008

(65) Prior Publication Data

US 2008/0196978 A1 Aug. 21, 2008

Related U.S. Application Data

(63) Continuation of application No. PCT/FI2006/000316, filed on Sep. 20, 2006.

(51) Int. Cl.
*B66B 1/20* (2006.01)

(52) U.S. Cl. ..... 187/384; 187/313; 187/390; 187/392

(58) Field of Classification Search ..... 187/247, 187/248, 313, 316, 380–388, 390–393
See application file for complete search history.

(56) References Cited

U.S. PATENT DOCUMENTS 4,874,063 A 10/1989 Taylor
5,435,416 A 7/1995 Siikonen et al.
5,979,607 A * 11/1999 Allen ..... 187/390
6,000,505 A 12/1999 Allen
7,182,174 B2 * 2/2007 Parrini et al. ..... 182/18
7,210,564 B2 * 5/2007 Kawai ..... 187/384
7,413,059 B2 * 8/2008 Kawai ..... 187/384
2004/0163325 A1 8/2004 Parrini et al.

FOREIGN PATENT DOCUMENTS

| | | | |
|---|---|---|---|
| EP | 1 004 536 | A1 | 11/1999 |
| EP | 1 433 735 | A1 | 6/2004 |
| FI | 20030614 | | 4/2003 |
| JP | 4-358680 | A | 12/1992 |
| JP | 5-147849 | A | 6/1993 |

* cited by examiner

*Primary Examiner*—Jonathan Salata
(74) *Attorney, Agent, or Firm*—Birch, Stewart, Kolasch & Birch, LLP

(57) ABSTRACT

In the method of the present invention an evacuation mode is presented in an elevator system, which receives destination calls i.e. operates in accordance with so-called destination control. In the method the destination floor calls given on the evacuation floors of the building are changed in the event of an exceptional incident such that the destination floor becomes an exit floor of the building. In the method the elevator car is filled as flail as possible on one floor and the travel time to the exit floor is minimized by directing the elevator car to the escape floor without intermediate stops. The passengers to be evacuated are shown information relating to the evacuation on a display located on the destination call panel and/or inside the car of the evacuation elevator.

18 Claims, 3 Drawing Sheets

BUILDING EVACUATION ELEVATOR SYSTEM

Figure 1:
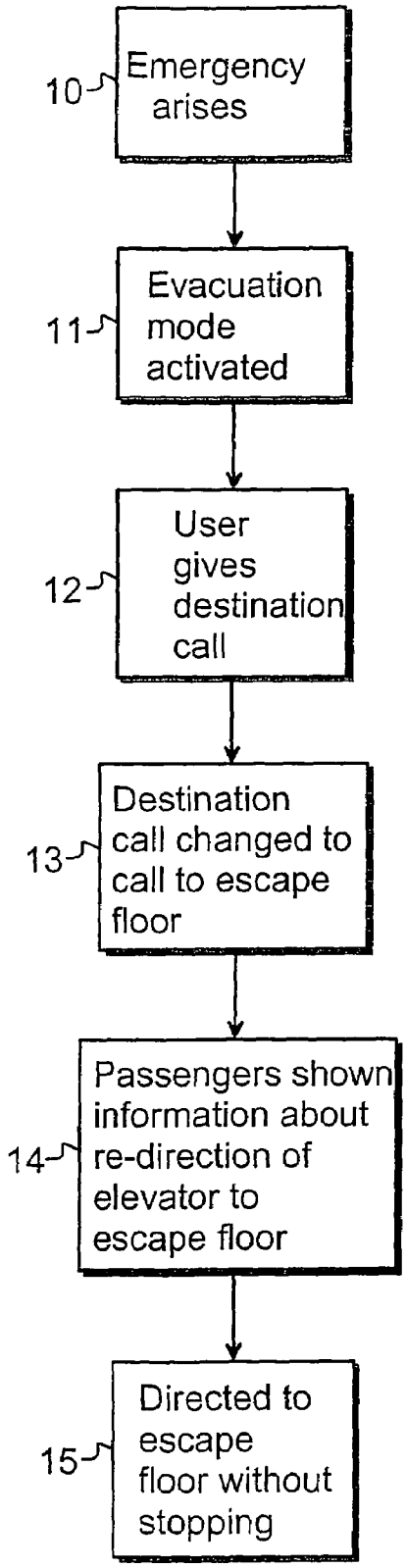

This application is a Continuation of co-pending Application No. PCT/FI2006/000316 filed on Sep. 20, 2006, and for which priority is claimed under 35 U.S.C. § 120; and this application claims priority of Application No. 20051038 filed in Finland on Oct. 14, 2005 under 35 U.S.C. § 119; the entire contents of all are hereby incorporated by reference.

FIELD OF THE INVENTION

The present invention relates to an elevator system that handles destination calls (so-called destination control), for which an evacuation mode for emptying the building in an emergency has been defined.

BACKGROUND OF THE INVENTION

If an exceptional incident occurs in a building, which can cause danger to the users of the building, it is important to enable a safe exit from the building for the users. This kind of serious exceptional incident can be e.g. a fire, an earthquake, a bomb threat or similar type of event, which is of danger to the people in the building. An evacuation order can be given to the building after detecting an exceptional incident, either for certain floors of the building or for the entire building. The transport systems located in the building, such as elevators, are in this case placed in an important role.

Generally all use of an elevator in the event of fire is separately prohibited. This is because a fire can seriously damage an elevator system, in which case elevators are no longer safe to use for evacuating people to the exit floor of the building. It is possible that the elevator stops working during an elevator run, in which case the elevator car may stop between floors leaving the elevator passengers trapped. In addition, a fire or smoke may spread strongly, especially along the elevator shaft, in which case the elevator is no longer a safe place owing to the oxygen supply or the heat. Also the extinguishing water used for extinguishing fires may damage the electrical parts of the system e.g. by causing short-circuits in the electronics parts of the system.

Additionally in the event of a fire it is not sensible to direct the elevator car and then open the doors to a floor on which the fire has progressed to an advanced stage. In this case the safety of the people already traveling in the elevator is endangered and the time needed for evacuation becomes longer, if it can be assumed that on this kind of floor there are no longer any people awaiting evacuation.

On the other hand, if the elevator system is constructed to be such that it withstands heat well or it is protected with suitable structures, the elevator system can very well be a feasible additional aid in the evacuation of the building. In tall buildings this is especially prominent, because the safe evacuation of a large number of people along the stairs and out of the building is extremely slow. If the elevators can be safely and reasonably controlled during an emergency, the evacuation time can be substantially shortened. It follows from the above that travel of the elevators in emergencies must be controlled in accordance with a special evacuation mode.

Publication U.S. Pat. No. 6,000,505 presents an appliance, with which a multiple level building can be evacuated during a fire incident using the elevator system. The appliance includes smoke detectors positioned on different floors. Elevator traffic is directed from the floors to be evacuated to the escape floor such that the doors of the elevator do not open on those floors on which a smoke detector detects smoke. The appliance also includes an emergency power source. The problem in the arrangement according to publication U.S. Pat. No. 6,000,505 is that the appliance is not able to forecast its own endurance and a consequence of this may be that the elevator could be performing an evacuation task at exactly the moment some critical component fails owing to e.g. strong heat in a fire incident.

Group control of elevators most typically means a way of managing the calls of an elevator system, in which the customer on the departure floor gives only direction information (up/down) to the call system. If several passengers arrive in the elevator lobby, who have the same direction of travel, the system does not know it before each of them has given information in the elevator car about his/her exact destination floor.

The so-called destination control of elevators means a destination call system, in which each elevator user gives his/her personal destination information to the elevator system in the elevator lobby before boarding the elevator car. This is implemented with a separate destination call panel in place of the up/down pushbuttons. In a destination system the giving of a separate call before entering the elevator car is not required and the stops of the elevators can be planned better than in conventional group control.

A problem with prior-art technology is that an effective evacuation mode in the event of an emergency has not previously been implemented for an elevator appliance included in a destination call system.

PURPOSE OF THE INVENTION

The purpose of the present invention is to disclose an evacuation mode for an elevator system that complies with the destination call system, with which a building equipped with the elevator system can be effectively and safely emptied of people in an exceptional situation, such as in the event of a fire or hurricane.

SUMMARY OF THE INVENTION

Some inventive embodiments of the systems and methods of the invention are presented in the drawings in the descriptive section of the present application. The inventive content of the application can also be defined in items of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

The present invention discloses a method for evacuating a building or a part of it by means of an elevator system, which elevator system contains a system for receiving destination calls (an elevator system with so-called destination control). The building contains one or more escape floors, and most typically the main lobby of the building functions as the escape floor. In the invention evacuation mode is activated when an exceptional incident, such as a fire or hurricane, is detected in the building or threatens the building. After this people seek their way in an emergency to the elevator lobbies, and the elevator system receives from them at least one destination call. On the basis of the destination call the control of the elevator system allocates to the people an evacuation elevator for the departure floor. A feature characteristic of the present invention is that the destination floor calls given are changed into calls to one of the escape floors of the building. After this the evacuation elevator fills with people and the evacuation elevator is directed to the escape floor, where people can leave the elevator car.

In one embodiment of the present invention the evacuation elevator is filled at the call-issuing floor until the threshold value set for the degree of filling of the elevator is reached. Further, in one embodiment of the present invention the desired percentage of the absolute maximum load of the evacuation elevator or the percentage of the existing space in the evacuation elevator or a certain time, during which the doors of the evacuation elevator are kept open at the floor to be evacuated, is set as the threshold value. Further, in one embodiment of the present invention the degree of filling of the elevator car is measured either by monitoring the interior space of the elevator car with at least one optical detector and/or by measuring the load of the elevator car.

Further, in one embodiment of the present invention passengers are shown in the car of the evacuation elevator and/or on the destination call panel information about the directing of destination floor calls to the escape floor and/or about the evacuation status and/or other information relating to the evacuation.

Further, in one embodiment of the present invention the building is divided into evacuation zones, in which case the zones can be a given different priority in respect of the serving of calls given in them. Further, in one embodiment of the present invention the elevators are allocated to call-issuing floors taking into account the number of people presumably on the floors and the number of people already evacuated to the escape floors. Further, in one embodiment of the present invention at least one evacuation model can be specified for the control of the elevator and the desired evacuation model can be selected for use either automatically or manually. After this the evacuation elevators can be directed to the calls given on the various floors according to the evacuation model selected. The desired evacuation model is selected for use on the basis of the severity and location of the exceptional incident as well as on the basis of the structures or the layout drawing of the building.

Further, in one embodiment of the present invention the operating capability of the elevators is predicted by means of temperature sensors and smoke detectors positioned in the building.

The inventive concept of the present invention also comprises a system, which implements the stages of the method described above with the various embodiments. One element of the system is a plurality of elevators, an elevator group controller, an alarm output signal for activating the evacuation mode, a destination call panel for giving calls in the elevator lobby, an evacuation management system for changing destination calls to one of the escape floors of the building.

Further in one of its embodiments the system comprises means for detecting the degree of filling of the elevator car, which can be e.g. optical detectors or means for measuring the mass of the elevator car. Further in one of its embodiments the system comprises a screen inside the elevator car and/or on the destination call panel for informing passengers.

The system can comprise at least one evacuation model stored in the elevator group controller. In addition the operating capability of the elevators can be detected with means for predicting operating capability, which receive input data from the control of each elevator. The operating capability forecast can be utilized in the evacuation models. Additional data for estimating the operating capability of the elevators is received with smoke detectors and temperature sensors, with which more detailed information e.g. about the extent of the fire is received.

One advantage of the present invention is that an effective evacuation mode has not previously been presented for an elevator system using a destination call system in a building subjected to or threatened by an exceptional incident. With the method and the appliance of the present invention the building can be more safely and effectively evacuated utilizing the transport capacity offered by the elevator system.

LIST OF FIGURES

Figure 2A:
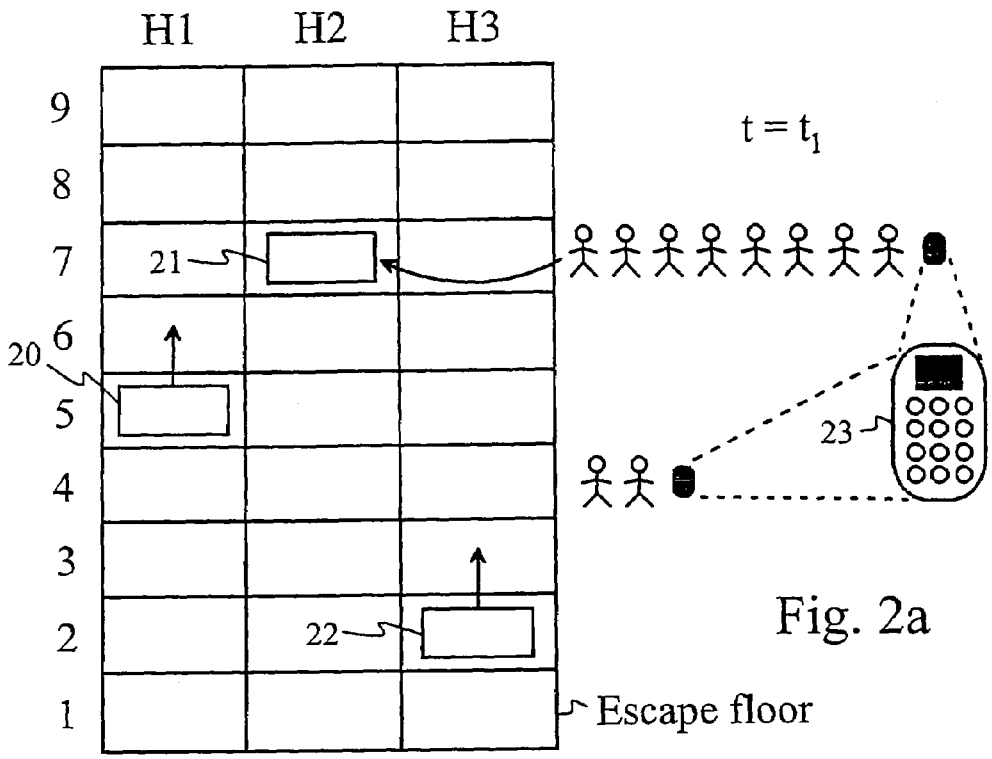
Figure 2B:
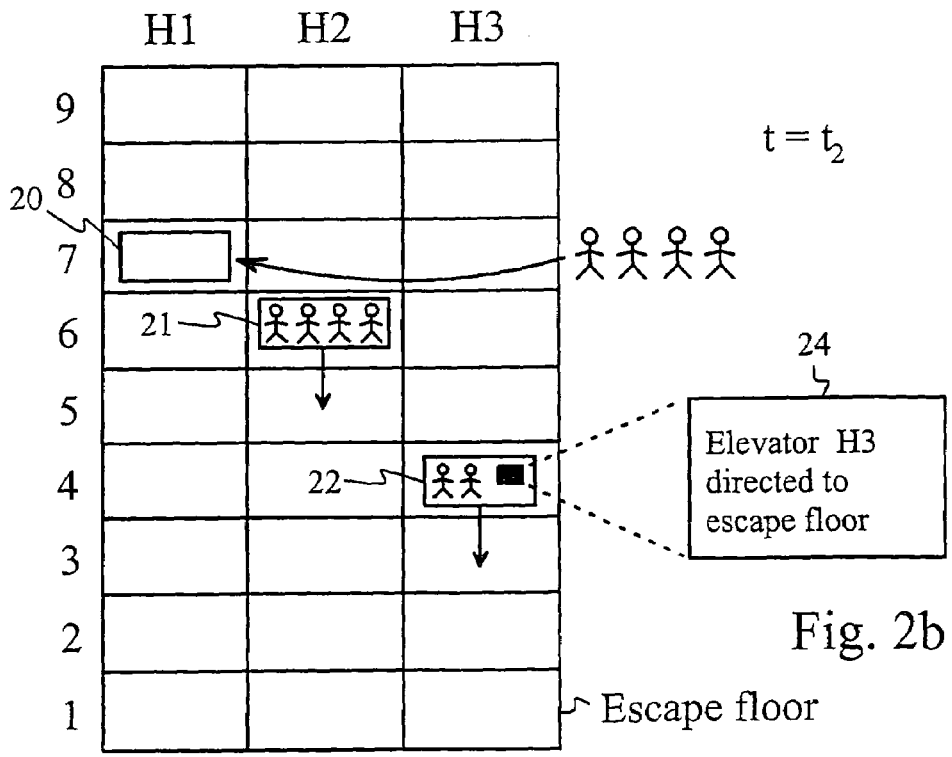
Figure 3:
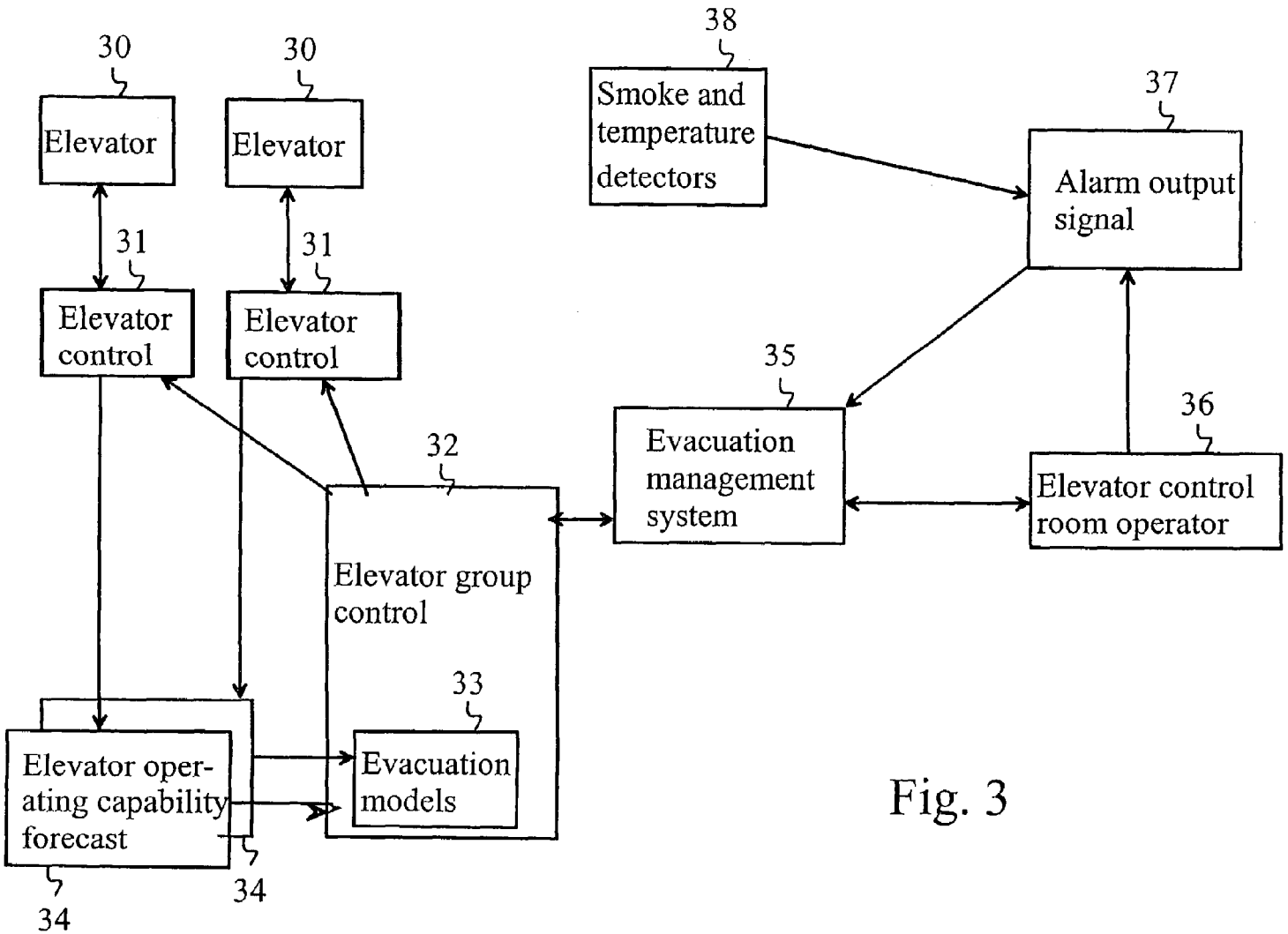

FIG. 1 presents one example of the different phases of the method according to the present invention for adopting evacuation mode in a destination call system, FIGS. 2*a* and 2*b* present one example of the allocation of passengers according to the present invention for elevators operating in evacuation mode, and FIG. 3 presents one example of the appliance according to the present invention for implementing evacuation mode in an elevator system.

DETAILED DESCRIPTION OF THE INVENTION

The present invention discloses an evacuation method that utilizes the elevator system when a type of exceptional incident is detected on one or more floors of a building, which requires that the floor is emptied of people. This type of exceptional incident can typically be a fire, earthquake or bomb threat. The present invention relates expressly to control of the elevators in a manner deviating from normal operating mode. The purpose of the system is naturally to minimize the time spent on transporting people to the escape floor of the building (which is typically the lobby floor of the building). This minimization of time cannot be achieved with the normal serving of elevator calls but instead a special evacuation mode must be taken into use. This evacuation mode is also essentially different depending on whether the elevator system is a conventional system that follows up-down calls and destination floor calls given in the elevator car or a so-called destination call system, in which the destination floor is given personally in the elevator lobby before stepping into the elevator. The present invention relates expressly to the latter, i.e. to destination control.

One assumption of the system is that the so-called evacuation mode is higher in priority than the normal operational mode. On the other hand in an exceptional situation at least a fire incident and other exceptional situations should be separated from each other, because a fire may damage the operation of the elevator system making it dangerous for users. In this case e.g. the elevators can be used in so-called fireman's mode, which allows firemen and their appliances access to the fire site. Another operating mode relating to a fire can be full evacuation mode (the whole building is emptied of people), if it can be assumed that the elevator system can withstand fires well. Another type of potential threat requiring evacuation is e.g. a hurricane or a bomb threat, which have not yet damaged the infrastructure of the building when the decision to evacuate is made. In this case it can be assumed that the elevator system operates as in normal circumstances also. A third potential threat consists of earthquakes, when their occurrence makes it sensible to drive elevators that are moving to the nearest floor at slow speed. One situation possibly requiring evacuation is complete disconnection of the building from the electricity network. In this case of course the elevator system requires one or more reserve power sources to operate.

A reserve power source can be a backup generator either for a specific elevator group or for a specific elevator, with which at least travel of the elevator in the lighter direction of travel to the nearest floor and exit of the passengers from the elevator at that floor can be ensured in the event of disconnection of the external power supply. Also the supply cable of the system can be duplicated by means of a reserve supply cable.

In an evacuation situation relating to fires an elevator system needs diverse data, so that the control of the system knows the floors to be evacuated, the elevators capable of operating and the progress status of the fire in all the different parts of the building. Smoke or temperature detectors/sensors can be utilized to inform the control system of the elevators and the fire service of the extent of the fire and the operating condition of the elevators. It is essential for the method according to the invention that irrespective of what destination floor call the elevator user gives, the destination floor of the call is changed to the emergency escape floor of the building before the starting of the elevator. The elevator car is filled as full as possible from one departure floor to avoid unnecessary under-utilization of transfer capacity in a critical situation. The escape floor or escape floors in an evacuation situation can be defined in advance in the evacuation plan stored in the controller of the elevators. In a full evacuation all floors are totally emptied of people by transferring them to the exit floors of the building. The default exit floor is the floor of the main lobby of the building. The exit floor/exit floors can also be changed remotely from the monitoring system of the elevators, if a need arises to change the default escape floor to some other.

In a destination call system the calls given are personal. In an emergency, how many people are awaiting evacuation in each elevator lobby on the different floors becomes the important factor and not which individual destination calls people in the elevator lobby have given. The destination calls given are rejected and replaced with calls to the emergency exit floor. Thus in this case all the destination calls given on one floor are collated together and a call to the emergency exit floor is formed from them. This is expressed to the elevator passengers e.g. on the display of the destination call panel and/or on the display inside the elevator car e.g. with the text "The elevator is being directed to emergency escape floor 1".

To ensure the usability of a system containing evacuation mode it is important that the user interface for giving elevator calls is similar in an emergency to that in a normal operating situation. Although the call appliance visible to the user is similar in normal mode and in evacuation mode, the control of the system registers the calls given in a different way.

The aforementioned monitoring system of the elevators provides the possibility to change the evacuation floor in real-time from outside the building. Different evacuation plans can also be stored in the system in advance, from where the desired evacuation plan can be activated according to the nature of the emergency. The evacuation plan can contain a distribution specifying how in a large elevator system the elevators are allocated to different departure floors. Also the escape floors used in an evacuation can vary between different evacuation plans. The stairs located in the building, which have an important role in an emergency even when the elevators are in operating condition, can be taken into account in all the evacuation plans.

A typical situation in the event of fire is that the evacuation of people from the building occurs in the early stage of the fire. Only after this, when the building is already empty, can the so-called fireman's mode in connection with the elevator system be taken into use, which can be activated from the monitoring center of the elevator system or from the burning building itself. The information provided by the smoke sensors and temperature sensors can be utilized in the monitoring center and emergency mode can be activated when these sensors issue an alarm automatically or manually by the personnel of the monitoring center. The sensors also provide floor-specific information about the location of the emergency and this can be utilized in deciding about the evacuation mode. With the sensors the temperature and the amount of smoke/gas in the lobby premises and in the elevator car as well as in the elevator shaft can be measured. A threshold value can be set for these quantities both according to human endurance capability as well as according to the operating capability of the elevator appliance itself. If one of the threshold values is exceeded, a traveling evacuation elevator is directed to the nearest safe escape floor. A smoke detector and a temperature sensor can also be positioned in the machine room of the elevator (if there is one in the system), in which case the operating status of the machines can be monitored. The temperature sensors can also be close to the doors of the elevator landings, so that the prevailing temperature near the elevator shaft on each floor can be monitored. Also the temperature of the door machinery of the elevator car and the pushbutton box of the elevator car can be monitored with a sensor. Based on the information received from the sensors the control system can deduce whether the elevator can go and open its doors at the floor it is called to or at the escape floor. Additionally the elevator shaft and the condition and operational status of the hoisting machine of the car can be monitored and also forecast, and if the risk of serious damage of the elevator grows very large, this kind of dangerous elevator can be excluded from an evacuation task or set to so-called fireman's drive mode.

The most critical aspect in an evacuation is the time it takes for the safe exit of people from the dangerous building. Owing to this it is essential from the standpoint of the elevator system to minimize the time between two consecutive visits of the elevators at the lobby, taking into account also the time taken for passengers to step into the car and to exit from the car. It is also essential that at one stop the elevator takes on as many people as possible and that the number of stops on one round trip is minimized. This is implemented when intermediate stops of the elevator during the evacuation trip are prohibited.

In normal operating mode there are certain safety margins in the filling of the elevator car e.g. between the notified maximum load in the car (the maximum number of passengers in the elevator car) and the maximum load of the car that the equipment withstands. This also gives travel comfort to users of the elevator. In evacuation mode these safety margins are compromised in order to achieve maximal operating efficiency. The elevator car can be accelerated and braked at the maximum power allowed by the system with no regard for the equipment.

In an emergency it is also important that the evacuation trip of each elevator car reaches its destination regardless of any breaking of non-critical parts.

In a preferred embodiment of the invention by measuring the load of the elevator car the number of people stepping into the elevator is detected. An upper limit is set for the load. The system can e.g. be set to operate such that the doors of the elevator start to close when 80% of the permitted load is reached. If there is an obstacle in the path of travel of the doors of the elevator, the doors can be specified to close despite this (nudging function). By setting the doors to close a little earlier than the moment maximum load is reached, it is possible to better ensure that the departure of the elevator is not delayed due to an overload. It can be estimated that during the nudging function a few additional passengers will still have time to enter the elevator, and in this way the load of the elevator will be optimized.

In the elevator car it is also possible to measure the degree of utilization of the floor area of the elevator or the degree of utilization of all the volume of the elevator during the evacuation trip. In this way it is known whether the elevator is full, even though the maximum weight limit of the elevator car is not yet reached. This function is useful when e.g. bed-ridden patients or wheelchair patients, who require relatively more space, are traveling in the elevator.

In one embodiment of the present invention the building can be divided into different zones, for each of which an individual escape floor can be defined. Division of the building into zones can be planned according to the population of the building (e.g. in an office building in accordance with the distribution of the locations of people's workplaces), the group distribution of the elevators, the escape routes and the compartmentalization of the building. The inclusion of zoning in the evacuation plan increases the efficiency of evacuation in an emergency, because in this way more elevators can be directed to serve floors on which there are assumed to be many people. Prioritization can also be specified for the zones. In this case a destination call received from a prioritized zone is served first and the calls of other zones are served only after this.

Video cameras can also be connected to the system, with which the situation in all the different parts of the building and the elevator shaft can if so desired be seen from the elevator monitoring site in the video surveillance picture, and thus a better view of e.g. the extent and severity of the fire is obtained. In addition a display can be used as an aid in the monitoring center, which shows the position, the state and direction of motion, and the currently valid calls of each elevator of the elevator system. Furthermore it is good for the layout drawings of the floors of the building and the locations of the stairs, elevator shaft and elevator lobbies to be available in the monitoring center.

The present invention is not limited only to systems of several elevators requiring group control but instead the invention can also be implemented in small systems, in which there is one elevator per stairwell.

The detectors/sensors connected to the system are not limited only to those mentioned above but instead any sensor at all that indicates a factor threatening the building can be integrated as a support of the evacuation mode of the elevator system. This kind of sensor can be e.g. a sensitive seismic detector, with which a large forthcoming earthquake can possibly be predicted.

Neither is the invention limited only to elevators as the transport system in question. The building can contain e.g. escalators, which can be arranged in pairs such that in normal operating mode one escalator transports people up a floor and the other down a floor. In an evacuation situation this kind of escalator pair can be set so that both escalators transport people in the same direction, towards the escape floor. In this way the transport capacity can be more efficiently utilized. The building can also contain another type of transport system, which can move e.g. in the horizontal direction (moving walkways of airport terminals). In addition, as mentioned in the above, normal stairs are in an important role in an emergency and their location must be taken into account when preparing evacuation models.

One preferred embodiment of the method according to the present invention can be described as a flow chart and this is presented in FIG. 1. It can be reasoned that initially in the building a so-called normal situation prevails and the elevators of the building operate also in normal operational mode. The situation changes when something exceptional occurs or threatens to occur in the near future. This could be a fire that starts somewhere in or near the building or an earthquake or an evacuation order caused by an approaching hurricane. Thus an emergency 10 is created. Either automatically based on the signals of detectors located in the building, an indication received from a user of the building or from an alarm issued by the operator of an external control room, an evacuation mode is activated 11 in the building and in its elevator system. In the following it is assumed that the alarm is of the nature that requires the immediate emptying of the whole building.

In an emergency people start to collect in the elevator lobbies of the building. Some of them use the stairs, which is indeed recommended in an emergency. The evacuation can, however, be significantly speeded up if the elevators are used as an aid in the evacuation. This of course depends on the elevator system being at least partly operational. Because the example is connected to the so-called destination call system, the elevator lobby contains a destination call panel, to which at least one person arriving in the elevator lobby gives his/her destination call 12. In the present invention it is not significant during evacuation mode which floor the user selected, because the control system of the elevator automatically changes the call to a down-call (assuming that the evacuation occurs from the top downwards) of one of the exit floors 13 of the building, which can also be called an escape floor. When the elevator allocated to the call arrives at the floor of the user location, the users (which presumably are so many that the elevator fills) step into the elevator. In one embodiment of the invention the doors of the elevator start to close when 80 percent of the permitted load of the elevator car is reached. Users arriving at the last moment still have time to enter the elevator, but nevertheless the load of the car does not exceed the absolute weight limit. The elevator starts towards the escape floor, which is typically the ground floor of the building or the floor of the main lobby. At this stage the display e.g. inside the elevator car shows passengers information about the directing of the elevator directly to the escape floor 14, because an evacuation situation exists. This prevents bewilderment of the passengers in a situation that is unusual, at worst dangerous, and in which the elevator possibly operates in contradiction to the user's destination call. After this the elevator is directed to the escape floor 15 without stopping and the doors are opened. The elevator passengers can leave the building and the elevator is released to serve new evacuating people.

One practical example of the control and filling of elevators in an emergency is presented in FIG. 2. The elevator system comprises three elevators 20, 21, 22, which are correspondingly H1, H2 and H3. It is assumed that there are nine floors in the building. It is further assumed that when an emergency arises it is decided to empty the whole building. The elevator system is thus set to so-called full evacuation mode. On floor seven is a large crowd of people, who must be evacuated and at least one of the crowd presses the destination call button (which is positioned on the destination call panel 23) he/she wants in the elevator lobby of his/her floor. On floor four, for its part, are two people waiting and at least one of them has in a similar manner given a destination call on floor four.

Elevator H2 is free and traveling upwards. After receiving a call from floor seven the system directs the elevator H2 to floor seven. At the same moment the elevators H1 and H3 are just being released for use from the ground floor of the building after completing the previous evacuation trip. In the following the first time described $t=t_1$ is analyzed in the situation of FIG. 2*a*. In this case the elevator H2 has arrived at floor seven and people start to move into the elevator car on this floor. Since slightly earlier so many destination calls were already given on floor seven that not everyone can be moved at one time in one elevator, the system allocates a second elevator H1 to serve floor seven also. At the time $t=t_1$ the elevator H1 is traveling upwards and is situated at floor five. At the same moment the elevator H3 allocated for the people on floor four is traveling upwards and situated at floor two.

Only a part of the people fit into the elevator H2, so it departs towards the ground floor full, but at the same time the elevators H1 and H3 reach the floors they are serving. In this case at the time $t=t_2$, which is described in FIG. 2*b*, the remainder of the people start moving into the elevator H1 on floor seven. Meanwhile on floor four the passengers have boarded the elevator H3, and the elevator departs towards the ground floor. In all the elevators in this example is a display 24 inside the elevator car, on which suitable information relating to the evacuation can be positioned for the elevator passengers to see. Likewise suitable information relating to the evacuation can be positioned also on the display 25 of the destination call panel 23 for the elevator passengers to see. Information relating to the evacuation can include information about the directing of destination floor calls to the escape floor, information about the status of the evacuation, information about the services of the escape floor or information about other similar issues related to the evacuation. In this example the elevator H3 tells its passengers "Elevator H3 is being directed to the escape floor", in which way the elevator passengers are aware of where the elevator is taking them despite the call given. At the time $t=t_2$ the elevator H2 is traveling towards the ground floor and is situated in this case at floor six. The elevator H2 does not by default stop on this trip and additionally the passengers of the elevator H2 are shown a bulletin according to the display 24 concerning the elevator H2. After the time $t=t_2$ also the elevator H1 starts its trip towards the ground floor, once the elevator is as full as possible.

FIG. 3 presents an example of a system, in which the present invention can be implemented. The system comprises elevators 30, each of which is controlled by its own elevator controller 31. Only two elevators are marked in the figure, but of course the system can contain more of them. It is assumed that the building is tall, in which case there are many elevators and there can be a number of elevator groups also. Namely it may be that one elevator group serves a certain floor-to-floor height in a tall building and another elevator group serves another certain floor-to-floor height. One elevator group is served by the elevator group control 32, which handles the allocation of elevators according to the currently valid calls and operating mode. The operating modes, which are stored in the memory of the group control 32, include an evacuation mode, which for its part may contain a number of evacuation models 33. The elevator control 31 measures the operating capability of the elevator 30, and in this example the elevator control 31 compiles an operating capability forecast 34 regarding the elevator that it controls. These operating capability forecasts are sent to the evacuation models 33 located in the group control 32, so that the model knows how long the elevator can still operate safely in evacuation use. Additionally the evacuation models can be edited or they can be increased based on the data of the operating capability forecast.

The elevator group control 32 is for its part connected bi-directionally to the evacuation management system 35. Information about the status and operating capability of the elevator group is received via this in a separate control room, in which an elevator control room operator 36 monitors the situation. The operator can control the elevator group 30 via evacuation management system 35.

Sensors or detectors 38 can be positioned in the building, which monitor e.g. the amount of smoke or gas in the air and on the other hand with the temperature sensors the temperature of the different floors of the building and the different parts of the elevator shaft as well as the temperature of the elevator car can be monitored. When one of the sensors detects that a certain threshold value has been exceeded, an alarm 37 is created, which is directed to the evacuation management system. Of course the control room operator 36 can also generate an alarm output signal 37 and via that switch on the evacuation mode he/she desires. When the evacuation mode is on, the elevators operate in accordance with the selected evacuation model 33 as explained in the method described above.

The invention is not limited solely to the embodiments described above, but instead many variations are possible within the scope of the inventive concept defined by the claims below. For example there can be one or more destination call panels in the same elevator lobby and the destination call panels can be positioned in one or more floors in the building. Also the displays showing information related to the evacuation can optionally be positioned either in the elevator cars or in the destination call panels or in both the elevator cars and the destination call panels.

The invention claimed is:

1. A method for evacuating a building or a part of it by means of an elevator system, in which the elevator system is a system that receives destination calls comprising one or more destination call panels, and in which building one or more exit floors are defined, comprising:

activating an evacuation mode as a consequence of an exceptional incident prevailing in a building or an exceptional incident threatening a building;

receiving at least one destination call;

allocating an evacuation elevator to the issuing floor of the destination call;

characterized in that the evacuation mode of the method further comprises:

setting a threshold value for the degree of filling of the elevator;

filling the evacuation elevator at the call-issuing floor until the threshold value set for the degree of filling of the elevator is reached;

changing each destination call received at said issuing floor to a destination floor of one of the escape floors; and directing the evacuation elevator to the escape floor.

2. The method according to claim 1, characterized in that the method further comprises:

setting as the threshold value the desired percentage of the absolute maximum load of the evacuation elevator or the percentage of the existing space in the evacuation elevator or a certain time, during which the doors of the evacuation elevator are kept open at the floor to be evacuated.

3. The method according to claim 1, characterized in that the method further comprises:

measuring the degree of filling of the elevator car either by monitoring the interior space of the elevator car with at least one optical detector and/or by measuring the mass of the elevator ear.

4. The method according to claim 1, characterized in that the method further comprises:

showing passengers on the destination call panel and/or in the car of the evacuation elevator information about the directing of destination floor calls to the escape floor and/or about the evacuation status and/or other similar information relating to the evacuation.

5. The method according to claim 1, characterized in that the method further comprises:

dividing the building into evacuation zones, which zones have a different priority in respect of the serving of calls given in them.

6. The method according to claim 1, characterized in that the method further comprises:

allocating elevators to call-issuing floors taking into account the number of people presumably on the floors and the number of people already evacuated to the escape floors.

7. The method according to claim 1, characterized in that the method further comprises:

defining at least one evacuation model in the control of the elevator;

the desired evacuation model is selected for use either automatically or manually; and the evacuation elevators are directed to the calls issued on the different floors according to the evacuation model selected.

8. The method according to claim 7, characterized in that the method further includes the phase:

selecting the desired evacuation model for use on the basis of the severity and location of the exceptional incident as well as en the basis of the structures of the building.

9. The method according to claim 1, characterized in that the method further comprises:

predicting the operating capability of the elevators by means of temperature sensors and smoke detectors positioned in the building.

10. A system for evacuating a building or a part of it by means of the elevator system, which comprises at least one elevator, and in which the elevator system is a system that receives destination calls, and for which building one or more exit floors are defined, and which system includes:

an elevator group controller;

an alarm output signal for activating the evacuation mode as a consequence of an exceptional incident prevailing in a building or an exceptional incident threatening a building; and one or more destination call panels on one or more floors of the building for receiving at least one destination call;

said elevator group controller for allocating an evacuation elevator to a floor issuing a destination call;

characterized iii that the system further includes:

an evacuation management system for changing the destination floor of each destination call received on the said call-issuing floor to one of the escape floors;

means for monitoring the deuce of filling of the elevator car for filling the evacuation elevator at the call-issuing floor until the threshold value set for the degree of filling of the elevator is reached; and said elevator group controller for directing the evacuation elevator to the escape floor.

11. The system according to claim 10, characterized in that the system further includes:

means for monitoring the degree of filling of the elevator car for setting the threshold value to the desired percentage of the absolute maximum load of the evacuation elevator or the percentage of the existing space in the evacuation elevator or a certain time, during which the doors of the evacuation elevator are kept open at the floor to be evacuated.

12. The system according to claim 10, characterized in that the means for monitoring the degree of filling of the elevator car monitor the interior space of the elevator car with at least one optical detector and/or measure the load of the elevator car.

13. The system according to claim 10, characterized in that the system further includes:

a display in the destination call panel and/or a display in the car of the evacuation elevator for informing passengers about the directing of destination floor calls to the escape floor and/or about the evacuation status and/or other information relating to the evacuation.

14. The system according to claim 10, characterized in that the system further includes:

an evacuation management system for dividing the building into evacuation zones, which zones have a different priority in respect of the serving of calls given in them.

15. The system according to claim 10, characterized in that the system further includes:

an elevator group controller for allocating elevators to call-issuing floors taking into account the number of people presumably on the floors and the number of people already evacuated to the escape floors.

16. The system according to claim 10, characterized in that the system farther includes:

at least one evacuation model specified in the controller of the elevator group;

an evacuation management system for selecting the desired evacuation model for use either automatically or manually; and an elevator group controller for directing the evacuation elevators to calls given on the different floors in accordance with the evacuation model selected.

17. The system according to claim 16, characterized in that in the system the desired evacuation model is selected for use on the basis of the severity and location of the exceptional incident as well as on the basis of the structures of the building.

18. The system according to claim 10, characterized in that the system further includes:

means for predicting the operating capability of the elevators by the aid of temperature sensors and smoke detectors positioned in the building.

* * * * *

UNITED STATES PATENT AND TRADEMARK OFFICE

CERTIFICATE OF CORRECTION

PATENT NO. : 7,588,126 B2
APPLICATION NO. : 12/078064
DATED : September 15, 2009
INVENTOR(S) : Marja-Liisa Siikonen et al.

It is certified that error appears in the above-identified patent and that said Letters Patent is hereby corrected as shown below:

On the Title Page:

Please insert the following:

-- (30) Foreign Application Priority Data

October 14, 2005 (FI) ..... 20051038 --.

Signed and Sealed this

Twenty-eighth Day of September, 2010

David J. Kappos

David J. Kappos
*Director of the United States Patent and Trademark Office*